US008764380B2

(12) United States Patent
Harvey et al.

(10) Patent No.: US 8,764,380 B2
(45) Date of Patent: Jul. 1, 2014

(54) ROTOR BLADE

(75) Inventors: Neil W. Harvey, Derby (GB); Stephane M. M. Baralon, Derby (GB)

(73) Assignee: Rolls-Royce PLC, London (GB)

( * ) Notice: Subject to any disclaimer, the term of this patent is extended or adjusted under 35 U.S.C. 154(b) by 351 days.

(21) Appl. No.: 13/174,176

(22) Filed: Jun. 30, 2011

(65) Prior Publication Data

US 2012/0009065 A1 Jan. 12, 2012

(30) Foreign Application Priority Data

Jul. 7, 2010 (GB) ..... 1011435.3

(51) Int. Cl.
*F01D 11/10* (2006.01)
*F01D 5/14* (2006.01)
*F01D 5/18* (2006.01)

(52) U.S. Cl.
USPC ..... 415/115; 415/171.1; 415/173.1; 415/914; 416/91; 416/231 R

(58) Field of Classification Search
USPC ..... 415/115, 171.1, 173.1, 914; 416/90 R, 416/91, 92, 96 R, 97 R, 97 A, 227 R, 227 A, 416/231 R, 231 A, 231 B
See application file for complete search history.

(56) References Cited

U.S. PATENT DOCUMENTS

| | | | | |
|---|---|---|---|---|
| 2,135,887 | A | 11/1938 | Fairey | |
| 2,160,323 | A | 5/1939 | Barnett | |
| 2,314,572 | A | 3/1943 | Chitz | |
| 2,340,417 | A | 2/1944 | Ellett | |
| 2,637,487 | A | 5/1953 | Sawyer | |
| 4,146,352 | A | 3/1979 | Yasugahira et al. | |
| 4,687,416 | A | 8/1987 | Spranger | |
| 6,435,815 | B2 | 8/2002 | Harvey et al. | |
| 7,320,575 | B2 | 1/2008 | Wadia et al. | |
| 2004/0091360 | A1 | 5/2004 | Yamawaki | |
| 2009/0220332 | A1 * | 9/2009 | Tsuchiya | 415/115 |

FOREIGN PATENT DOCUMENTS

| | | | | |
|---|---|---|---|---|
| DE | 10 2008 052 981 | A1 | 4/2010 | |
| EP | 1 118 747 | A2 | 7/2001 | |
| EP | 1 785 589 | A1 | 5/2007 | |
| EP | 1 947 294 | A2 | 7/2008 | |
| GB | 293656 | | 7/1928 | |
| GB | 383821 | | 11/1932 | |
| GB | 396716 | | 8/1933 | |
| GB | 736835 | | 9/1955 | |
| JP | A-2005-240749 | | 9/2005 | |
| WO | WO-2007/116621 | A1 * | 10/2007 | F04D 29/66 |

OTHER PUBLICATIONS

British Search Report issued in British Application No. GB1011435.3 dated Oct. 15, 2010.

* cited by examiner

*Primary Examiner* — Christopher Verdier
(74) *Attorney, Agent, or Firm* — Oliff PLC

(57) ABSTRACT

A rotor blade for a gas turbine engine, comprising an aerofoil having pressure and suction surfaces, leading and trailing edges, and an array of passages at a tip region of the aerofoil. The passages extend from the pressure surface to the suction surface of the aerofoil and are disposed so that the array creates, in operation, a planar jet of gas issuing from the suction surface. The jet is inclined outwardly from the suction surface and towards the tip, and in the direction from the leading edge to the trailing edge. The jet inhibits migration away from the suction surface of a clearance vortex formed by leakage of air over the tip of the rotor blade.

20 Claims, 5 Drawing Sheets

ROTOR BLADE

BACKGROUND OF THE INVENTION

This invention relates to a rotor blade for a turbo machine, and is particularly, but not exclusively, concerned with a rotor blade for an axial compressor of a turbine engine.

Axial compressors for turbine engines typically comprise at least one rotor having an array of rotor blades arranged circumferentially about a hub. The rotor blades have an aerofoil cross-section with a suction surface and a pressure surface. The rotor is disposed within a casing which defines an annular flow passage through the engine, across which the rotor blades extend. The casing is disposed radially outwardly of the tips of the rotor blades so that a clearance gap is provided between the tips of the rotor blades and the casing thereby allowing the rotor to rotate.

In operation, the rotor is rotated at high speed. Air drawn into the engine is turned by the rotor blades. As the air is turned the pressure acting on the pressure surface of the aerofoil increases and the pressure acting on the suction surface of the aerofoil decreases.

A problem associated with this arrangement is that the clearance gap between the rotor blade and the casing provides a flow path for air to leak from the pressure surface of the aerofoil to the suction surface. This leakage flow interacts with the main stream flow between the rotor blades in the region adjacent the aerofoil suction surface and typically rolls up into a vortex, known as a clearance vortex, which extends downstream and away from the suction surface.

Mixing of the clearance vortex with the main stream flow between the rotor blades reduces the aerodynamic efficiency of the of the blade row.

Furthermore, the clearance vortex has an upstream velocity component which counteracts the oncoming flow and so reduces the net downstream velocity of the main stream flow. In normal operation, the main flow is sufficient to counteract the upstream velocity component of the clearance vortex and entrain the clearance vortex downstream in the main flow. However, tip leakage is problematic when the compressor is throttled because throttling reduces the downstream velocity of the main flow. In addition, throttling increases the pressure difference (i.e. lift) between the pressure surface and the suction surface which increases the amount of leakage flow which strengthens the clearance vortex. The main flow is thus less able to entrain the clearance vortex and the vortex grows away from the suction surface towards the pressure surface of an adjacent blade. Eventually the casing end wall flow is blocked by the upstream flowing clearance vortex, significantly advancing the onset of stall. The surge margin of the rotor is thus significantly reduced.

Known methods for reducing tip leakage include using shrouded rotor blades; applying treatments to the tips of the rotor blades or the casing, such as slots to improve flow characteristics over the tip; and incorporation of swept, angled or profiled rotor blades.

These methods are known to incur significant penalties with respect to weight, complexity and/or reduced aerodynamic efficiency.

BRIEF SUMMARY OF THE INVENTION

According to a first aspect of the invention there is provided a rotor blade for a turbo machine, comprising an aerofoil having pressure and suction surfaces, leading and trailing edges, and an array of passages at a tip region of the aerofoil, which passages extend from the pressure surface to the suction surface of the aerofoil and are disposed so that the array creates, in operation, a coherent jet of gas issuing from the suction surface, the jet being inclined outwardly from the suction surface and towards the tip, and in the direction from the leading edge to the trailing edge.

The passage outlets, or most of the passage outlets, may be situated at a distance from the tip which is not less than 1% and not more than 25% of the span of the aerofoil. The span extends from blade tip to the base of the blade.

The passage outlets, or most of the passage outlets, may be situated at a distance not more than 25% of the chord of the aerofoil from the leading edge. The chord extends between the leading edge and the trailing edge of the blade.

The passages may be disposed such that individual jets of gas coalesce to make up the coherent jet. The passages may be inclined to the suction surface in a tipwise direction at angles which are not less than 10 degrees.

The passages may be disposed such that individual jets of gas coalesce to make up the coherent jet. The passages may be inclined to the suction surface in the direction from the leading edge to the trailing edge at angles which are not less than 10 degrees.

The spanwise extent of some of the flow passages with respect to the spanwise direction of the aerofoil may exceed their chordwise extent.

At least some of the passage outlets may be spaced apart from each other in the spanwise direction of the aerofoil.

At least some of the passage outlets may be spaced apart from each other in a chordwise direction of the aerofoil.

The rotor blade may be a fan blade.

According to a second aspect of the invention there is provided a rotor assembly comprising a rotor, having an array of rotor blades in accordance with the first aspect of the invention, and a casing disposed radially outwardly of the tips of the rotor blades, wherein the rotor is arranged for rotation with respect to the casing and the rotor blades are arranged with respect to the casing such that, in use, the coherent jets of gas issuing from the respective suction surfaces are directed towards the casing thereby inhibiting the growth of the clearance vortices towards their adjacent rotor blades.

According to a third aspect of the invention there is provided a gas turbine engine comprising a rotor blade according to the first aspect of the invention, or a rotor assembly according to the second aspect of the present invention.

BRIEF DESCRIPTION OF THE DRAWINGS

For a better understanding of the present invention, and to show more clearly how it may be carried into effect, reference will now be made, by way of example, to the accompanying drawings, in which: —

DETAILED DESCRIPTION OF THE INVENTION

Figure 1:
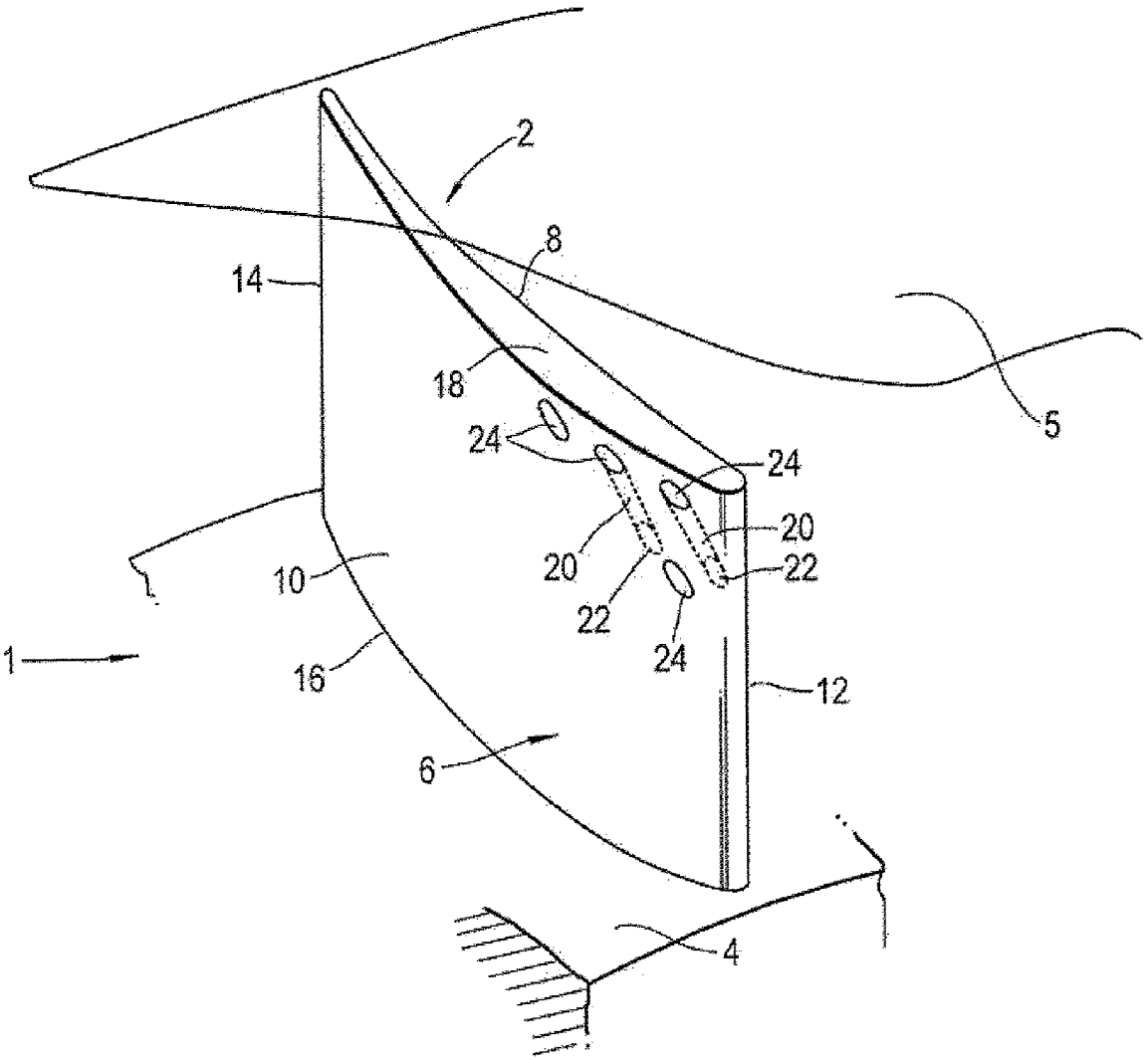
FIG. 1 is a schematic representation of a rotor blade attached to a rotor hub.

FIG. 1 shows a rotor assembly of an axial flow compressor, comprising a rotor 1 and a casing 5. The rotor 1 comprises a rotor blade 2 mounted to a rotor hub 4. The rotor blade 2 is one of a plurality of rotor blades (others not shown) arranged about the rotor hub 4 in a circumferential direction. The rotor 1 is disposed for rotation in the casing 5. The rotor blade 2 comprises an aerofoil 6 having pressure and suction surfaces 8, 10 and leading and trailing edges 12, 14. The pressure surface 8 is concave from the leading edge 12 to the trailing edge 14 and the suction surface 10 is convex from the leading edge 12 to the trailing edge 14.

The rotor blade 2 has a root 16 adjacent the rotor hub and a tip 18. The tip 18 is spaced away from the casing 5 so as to provide clearance between the tip 18 and the casing 5. This clearance allows the rotor 1 to rotate without contacting the casing 5.

The aerofoil 6 is provided with an array of cylindrical flow passages 20 (two of these passages are shown in outline in FIG. 1). The embodiment shown has four flow passages 20. The flow passages 20 may, for example, be machined or cast into the aerofoil 6. Each flow passage 20 extends from the pressure surface 8 to the suction surface 10 thereby defining an inlet 22 at the pressure surface 8 and an outlet 24 at the suction surface 10. Three of the flow passages 20 are arranged in a line in a chordwise direction of the rotor blade 2.

Figure 2:
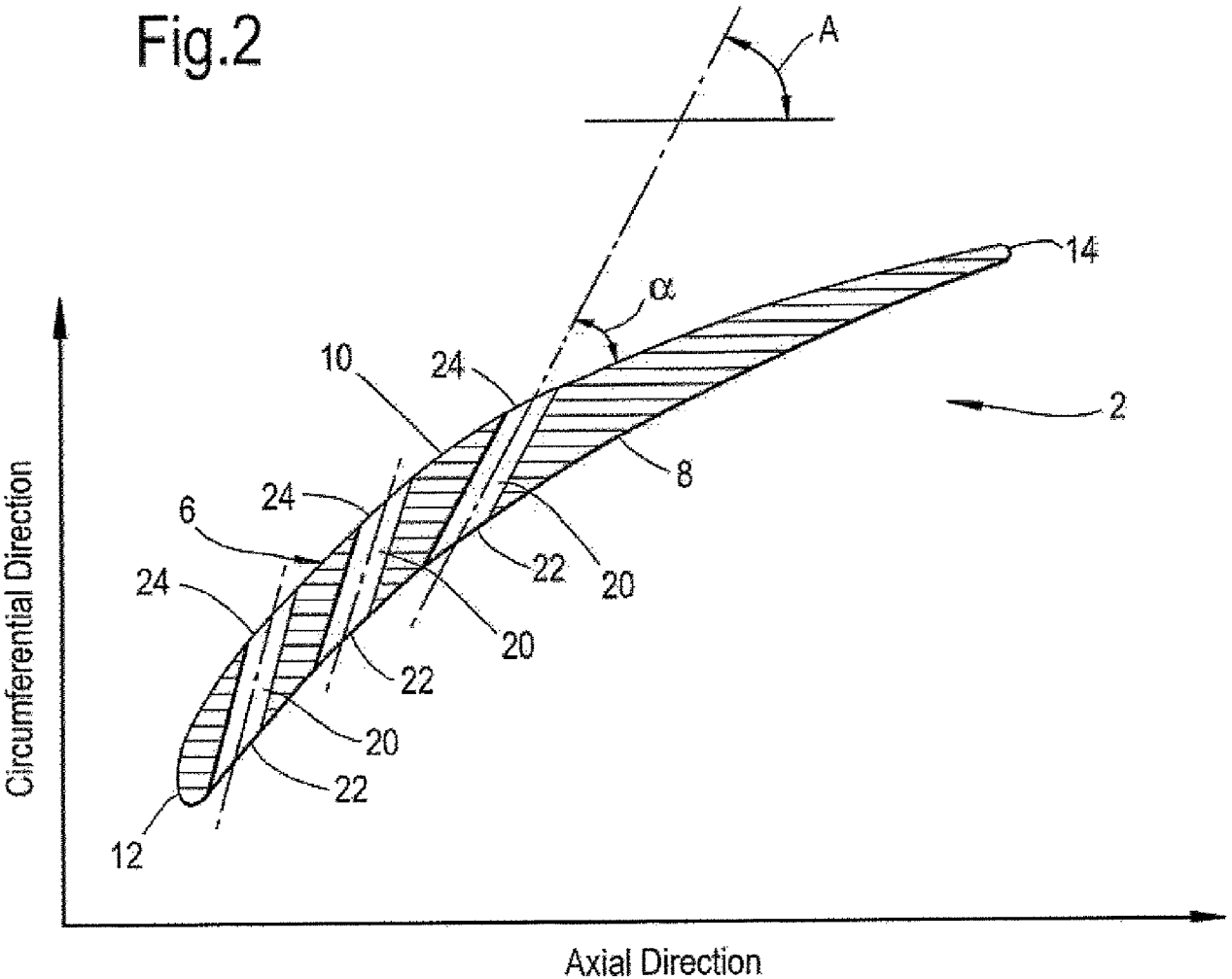
FIG. 2 is a sectional view of the rotor blade shown in FIG. 1 taken in a chordwise plane of the blade.

As shown in FIG. 2, the flow passages 20 are inclined to the suction surface 10 in the direction from the leading edge 12 to the trailing edge 14 (chordwise direction). Each passage is inclined at an angle $\alpha$ of not less than 10° to the suction surface 10 at 5 the point at which the respective outlet 24 emerges. The flow passages 20 are inclined towards the trailing edge 14 at an angle which is not more than 90 degrees to the axial direction of the rotor hub 4. In the embodiment shown in FIG. 2, the angle $\alpha$ is approximately 30° and may, for example, fall in the range 10° to 45°. The angle A is the angle of the passages to the axial direction of the engine.

Figure 3:
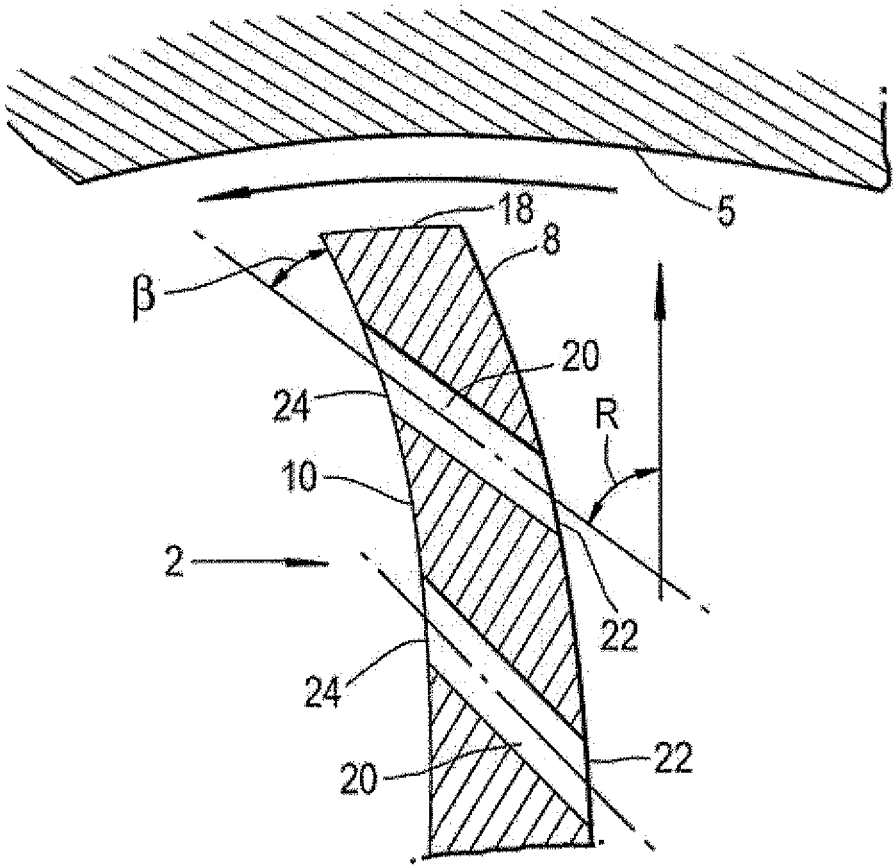
FIG. 3 is a partial sectional view of the rotor blade shown in FIG. 1 taken in a spanwise plane of the blade.

As shown in FIG. 3, each passage 20 is also inclined from the inlet 22 to the outlet 24 in the tipwise direction. Each flow passage 20 is inclined at an angle 13 of not less than 10° to the suction surface 10 at the point at which the respective outlet 24 emerges. In the embodiment shown in FIG. 3, the angle 13 is approximately 30° and may, for example, fall in the range 10° to 45°. The flow passages 20 are thus inclined to the radially outward direction with respect to the rotor hub 4, and the outlets 24 are disposed radially outwardly of the inlets 22 with respect to the rotor hub 4. The angle R is the angle of the passages to the radial direction of the engine.

The passage outlets 24 are situated at a distance from the tip 18 which is not less that 1% and not more than 25% of the length of the aerofoil 6 in a spanwise direction.

Figure 4:
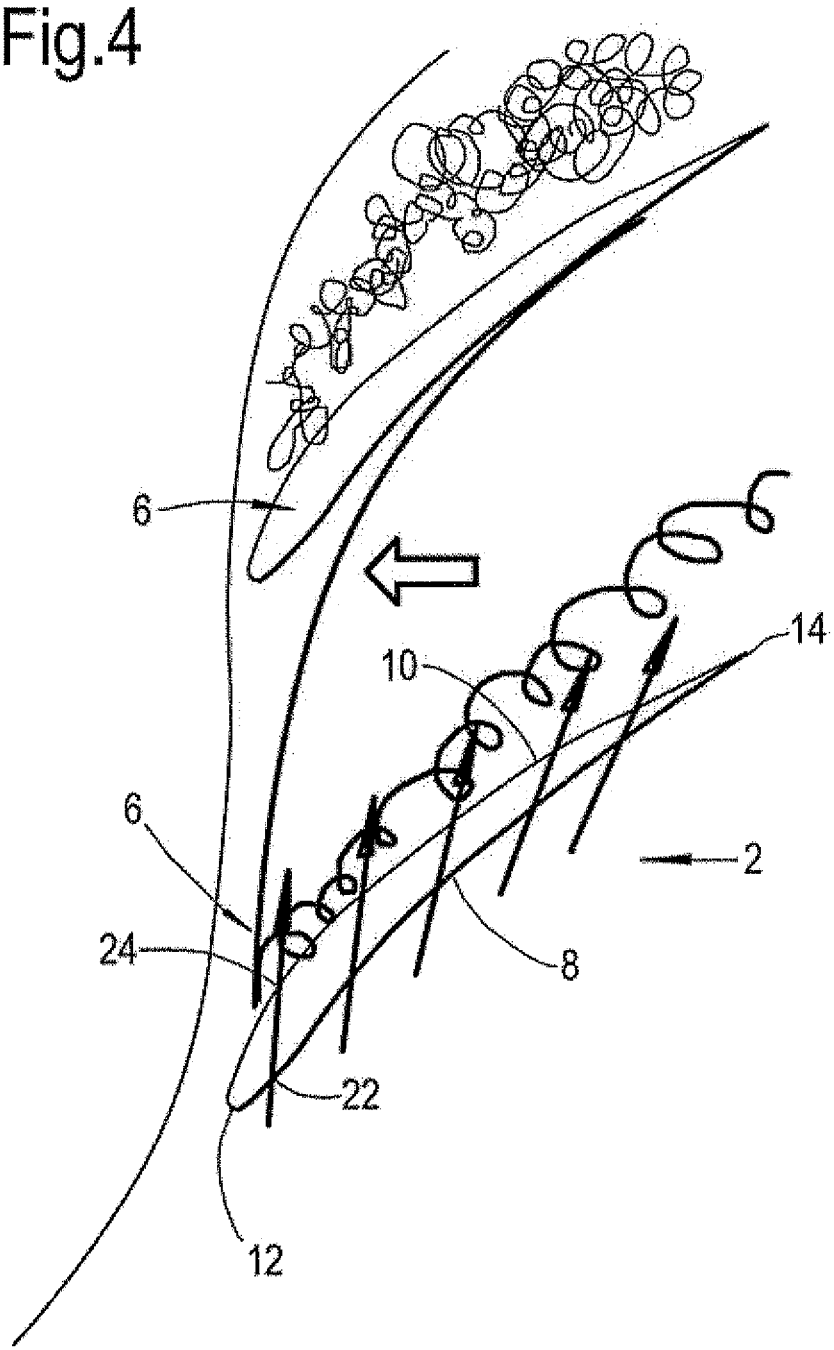
FIG. 4 is a schematic representation of flow about a rotor blade.

In use, the rotor 1 is rotated with respect to the casing 5. Air turned by the rotor blade 2 flows over the aerofoil 6 from the leading edge 12 towards the trailing edge 14. The pressure acting on the pressure surface 8 is greater than the pressure acting on the suction surface 10. This pressure difference causes air to "leak" over the tip 18 of the rotor blade 2 from the pressure surface 8 to the suction surface 10 and roll up into a clearance vortex emanating from the tip 18 adjacent the leading edge 12, as shown in FIG. 4. The clearance vortex extends away from the suction surface 10 and towards the trailing edge 14.

Air is also drawn through the inlets 22 at the pressure surface 8 and along the flow passages 20 towards the suction surface 10. The air exits from each outlet 24 as a high velocity jet directed radially outwardly and rearwardly from the suction surface 10. The jets emitted from the respective outlets 24 coalesce to form a coherent jet which impinges on the surrounding casing 5. The coherent jet forms a barrier of high velocity air which extends substantially from the leading edge 12 to the trailing edge 14 of the aerofoil 6. The jet, suction surface 10 and casing 5 thus bound the region adjacent the tip 18 within which the clearance vortex forms. The clearance vortex is thus suppressed and therefore inhibited from mixing with the mainstream flow, thereby improving the efficiency of the rotor 1.

When the rotor blade 2 is not highly loaded aerodynamically, for example at the design point of the rotor 1, the pressure difference across the pressure and suction surfaces 8, 10 produces a relatively low energy clearance vortex and a relatively low energy or low velocity coherent jet. As the aerodynamic loading on the rotor blade 2 increases (i.e. the pressure difference between the pressure and suction surfaces increases), for example when the rotor 1 is throttled, the pressure difference between the pressure and suction surfaces 8, 10 increases. The increased pressure difference increases the strength of the clearance vortex. In addition, throttling reduces the flow of air through the rotor 1 and across the suction surface 10. The increase in the strength of the clearance vortex coupled with the reduction in the amount of over the suction surface 10 results in migration of the clearance vortex away from the suction surface 10 towards the adjacent rotor blade. The position towards which the strengthened clearance vortex begins to migrate is depicted in FIG. 4 by the curved line originating from the start of the vortex at the region of the tip 18 adjacent the leading edge 12.

However, movement of the clearance vortex away from the suction surface 10 is inhibited by the barrier of high velocity air formed by the coherent jet. The coherent jet thus contains the clearance vortex in the tip region bounded by the suction surface 10, casing 5 and coherent jet and delays the onset of stall. The increase in the pressure difference across the pressure and suction surfaces 8, 10 also increases the amount of flow through the flow passages 20 and so increases the strength of the coherent jet. The strength of the coherent jet thus increases as the strength of the clearance vortex increases. Consequently, the coherent jet is most effective at containing the clearance vortex when the pressure difference across the pressure and suction surfaces 8, 10 is greatest which coincides with the clearance vortex at its strongest.

Moreover, since the amount of flow through the flow passages 20 reduces during normal operation (i.e. at the design point) the pressure losses caused by flow through the flow passages 20 are less at the design point than when the compressor is throttled. The flow passages 20 thus provide an effective way to delay stall and improve the surge margin of the rotor 1 whilst limiting the impact on operating efficiency.

Figure 5:
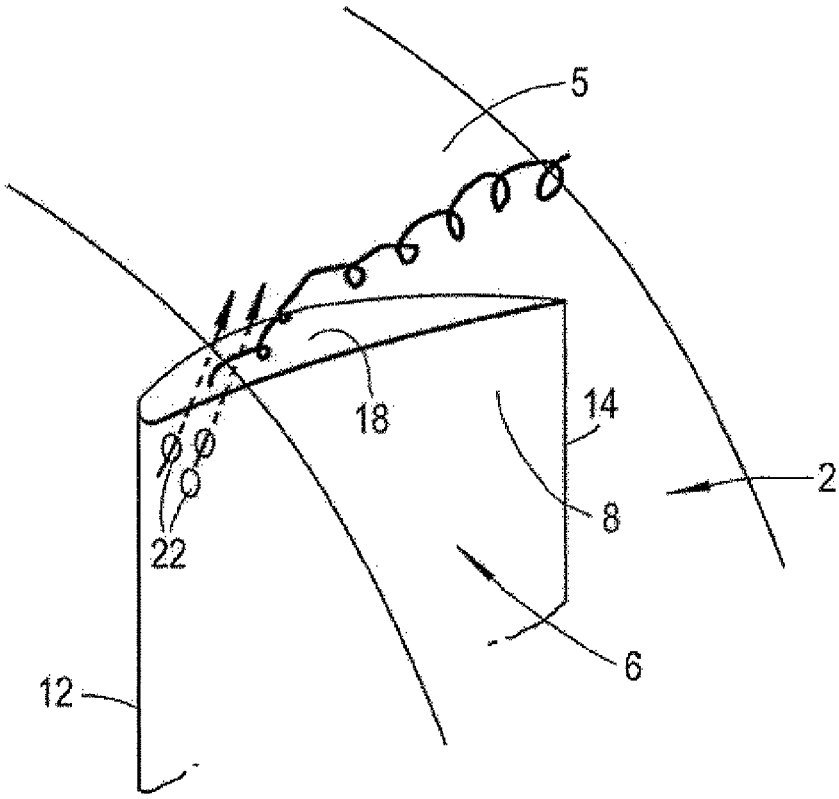
FIGS. 5 and 6 are schematic representations of flow about a rotor blade according to a further embodiment.
Figure 6:
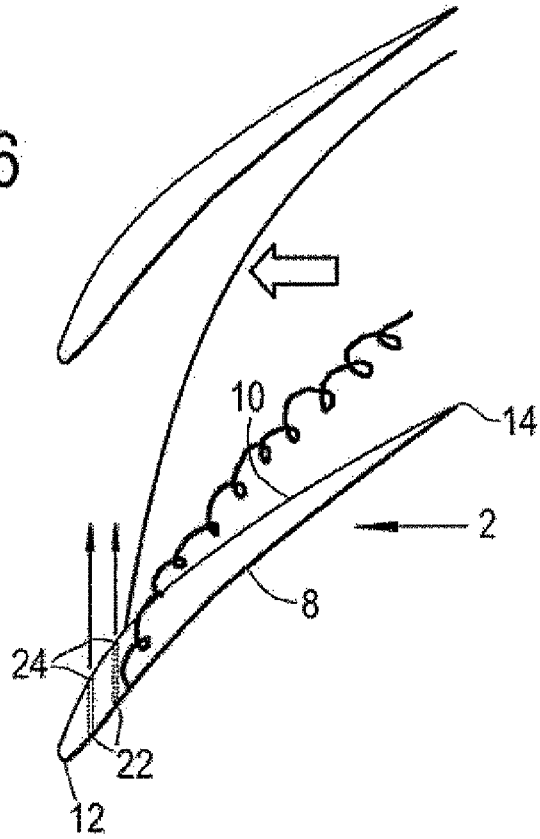

FIGS. 5 and 6 show an alternative embodiment in which the flow passages 20 are concentrated near the leading edge 10 of the aerofoil 6.

In use, when the rotor blade is not highly loaded aerodynamically (i.e. at the design point), the coherent jet lies alongside and primarily forward of the clearance vortex. When the aerodynamic loading increases, the clearance vortex migrates forward and away from the suction surface 10 until it is constrained by the coherent jet. The coherent jet thus constrains the vortex at the high loading condition and therefore only when it is necessary to prevent onset of stall. Using fewer flow passages 20 reduces the aerodynamic losses during operation whilst maintaining effective constraint of the clearance vortex in the high loading condition. Furthermore, positioning the flow passages 20 near the leading edge 12 means that the strength of the coherent jet is more sensitive to the incidence of the aerofoil 6. The coherent jet is thus most effective at the larger aerofoil angles of incidence to the oncoming flow which are typical at near stall conditions.

It will be appreciated that the distance of the outlets 24 from the tip 18 of rotor blade 2, the area of the flow passages 20 and the inclination of the flow passages 20 with respect to the suction surface 10 have a combined effect on the resultant coherent jet. Consequently, it will be understood that these parameters may be modified to generate a coherent jet having desired characteristics, such as flow rate and direction, at a specified design condition.

The flow passages can be elliptical or some other generally smooth and regular shape in cross-section. The flow passages may be curved, for example to connect desired regions of the suction and pressure surfaces. The passages may have varying cross-sectional areas along their lengths. There may, for example be not less than two and not more than ten flow passages.

The invention may be used to improve the surge margin of a rotor; for example, when it is desirable to incorporate aerofoils which can be highly loaded without reducing the surge margin below acceptable limits.

inhibiting the growth of the clearance vortices may also be used to reduce noise produced by a rotor during operation away from its design flow condition.

The invention claimed is:

1. A rotor blade for a turbo machine, comprising:

an aerofoil having pressure and suction surfaces, leading and trailing edges; and an array of passages at a tip region of the aerofoil, wherein the passages extend from the pressure surface to the suction surface of the aerofoil and are disposed so that the array creates, in operation, individual jets of gas which exit the passages and coalesce at a point to form a coherent jet of gas issuing from the suction surface, the jet being inclined outwardly from the suction surface and towards the tip, and in the direction from the leading edge to the trailing edge, and wherein at least 50% of the passage outlets, are situated at a distance from the tip which is not less than 1% and not more than 25% of the span of the aerofoil and at least 50% of the passage outlets, are situated at a distance not more than 25% of the chord of the aerofoil from the leading edge.

2. A rotor blade according to claim 1, wherein the coherent jet is of planar form.

3. A rotor blade according to claim 1, in which the passages are disposed such that the individual jets of gas, which coalesce to make up the coherent jet, are inclined to the suction surface in a tipwise direction at angles which are not less than 10 degrees.

4. A rotor blade according to claim 1, in which the passages are disposed such that the individual jets of gas, which coalesce to make up the coherent jet, are inclined to the suction surface in the direction from the leading edge to the trailing edge at angles which are not less than 10 degrees.

5. A rotor blade according to claim 1, in which at least some of the passage outlets are spaced apart from each other in the spanwise direction of the aerofoil.

6. A rotor blade according to claim 1, in which at least some of the passages are spaced apart from each other in a chordwise direction of the aerofoil.

7. A rotor blade according to claim 1, wherein the passages extending from the pressure surface to the suction surface of the aerofoil are disposed at a non-parallel angle with respect to each other so that the array creates, in operation, the coherent jet of gas issuing from the suction surface.

8. A rotor blade for a turbo machine, comprising:

an aerofoil having pressure and suction surfaces, leading and trailing edges; and an array of passages at a tip region of the aerofoil, wherein the passages extend from the pressure surface to the suction surface of the aerofoil and are disposed at a non-parallel angle with respect to each other so that the array creates, in operation, a coherent jet of gas issuing from the suction surface, the jet being inclined outwardly from the suction surface and towards the tip, and in the direction from the leading edge to the trailing edge.

9. A rotor blade according to claim 8, in which at least some of the passages are spaced apart from each other in a chordwise direction of the aerofoil.

10. A rotor blade according to claim 8, in which the array creates, in operation, individual jets of gas which exit the passages and coalesce to form the coherent jet of gas.

11. A rotor blade according to claim 8, in which at least 50% of the passage outlets, are situated at a distance from the tip which is not less than 1% and not more than 25% of the span of the aerofoil and at least 50% of the passage outlets, are situated at a distance not more than 25% of the chord of the aerofoil from the leading edge.

12. A rotor assembly comprising:

a rotor, having an array of rotor blades at least some of which comprise an aerofoil having pressure and suction surfaces, leading and trailing edges, and an array of passages at a tip region of the aerofoil, which passages extend from passage inlets in the pressure surface to passage outlets in the suction surface of the aerofoil and are disposed so that the array creates, in operation, individual jets of gas which exit the passages and coalesce at a point to form a coherent jet of gas issuing from the suction surface, the jet being inclined outwardly from the suction surface and towards the tip, and in the direction from the leading edge to the trailing edges; and a casing disposed radially outwardly of the tips of the rotor blades, wherein the rotor is arranged for rotation with respect to the casing and the rotor blades are arranged with respect to the casing such that, in use, the coherent jets of gas issuing from the respective suction surfaces are directed towards the casing thereby inhibiting the growth of clearance vortices towards pressure surfaces of adjacent rotor blades.

13. A rotor assembly according to claim 12, in which the passage outlets, or most of the passage outlets, are situated at a distance from the tip which is not less than 1% and not more than 25% of the span of the aerofoil.

14. A rotor assembly according to claim 12, in which the passage outlets, or most of the passage outlets, are situated at a distance not more than 25% of the chord of the aerofoil from the leading edge.

15. A rotor assembly according to claim 12, wherein the coherent jet is of planar form.

16. A rotor assembly according to claim 12, in which the passages are disposed such that the individual jets of gas, which coalesce to make up the coherent jet, are inclined to the suction surface in a tipwise direction at angles which are not less than 10 degrees.

17. A rotor assembly according to claim 12, in which the passages are disposed such that the individual jets of gas, which coalesce to make up the coherent jet, are inclined to the suction surface in the direction from the leading edge to the trailing edge at angles which are not less than 10 degrees.

18. A rotor assembly according to claim 12, wherein each blade is a fan blade.

19. A rotor blade according to claim 12, wherein each blade is a compressor blade.

20. A rotor assembly according to claim 12, wherein passages extending from passage inlets in the pressure surface to passage outlets in the suction surface of the aerofoil are disposed at a non-parallel angle with respect to each other so that the array creates, in operation, the coherent jet of gas issuing from the suction surface.

* * * * *